United States Patent [19]

Wada et al.

[11] Patent Number: 5,048,477

[45] Date of Patent: Sep. 17, 1991

[54] FUEL SUPPLY SYSTEM FOR AN ENGINE

[75] Inventors: Minoru Wada, Nishitamagun; Tetsuo Yamagishi, Musashimurayama; Isao Morooka, Oume, all of Japan

[73] Assignee: Komatsu Zenoah Kabushiki Kaisha, Tokyo, Japan

[21] Appl. No.: 330,081

[22] PCT Filed: Jul. 6, 1988

[86] PCT No.: PCT/JP88/00682

§ 371 Date: May 8, 1989

§ 102(e) Date: May 8, 1989

[87] PCT Pub. No.: WO89/00239

PCT Pub. Date: Jan. 12, 1989

[30] Foreign Application Priority Data

| | | | |
|---|---|---|---|
| Jul. 6, 1987 | [JP] | Japan | 62-166862 |
| Jan. 22, 1988 | [JP] | Japan | 63-10974 |
| Jan. 22, 1988 | [JP] | Japan | 63-10975 |
| Jun. 29, 1988 | [JP] | Japan | 63-85027 |

[51] Int. Cl.[5] ..... F02M 1/10

[52] U.S. Cl. ..... 123/180 P; 123/180 T

[58] Field of Search ..... 123/180 P, 179 G, 179 L, 123/180 E, 180 T, 187.5 R

[56] References Cited

U.S. PATENT DOCUMENTS

| | | | |
|---|---|---|---|
| 3,614,945 | 10/1971 | SchlagMüller et al. | 123/179 G |
| 3,704702 | 12/1972 | Aono | 123/179 G |
| 4,441467 | 4/1984 | Powell | 123/179 G |
| 4,554,896 | 11/1985 | Sougawa | 123/187.5 R |
| 4,676,204 | 6/1987 | Inoguchi et al. | 123/180 P |

FOREIGN PATENT DOCUMENTS

| | | | |
|---|---|---|---|
| 59-15641 | 1/1984 | Japan | 123/179 G |
| 1444185 | 7/1976 | United Kingdom | 123/179 G |

OTHER PUBLICATIONS

Patent Abstracts of Japan, vol. 10, No. 138, May 21, 1986 (relative to JP-A-60 261 967-Aisan Kogyo K.K.)

*Primary Examiner*—Andrew M. Dolinar

*Attorney, Agent, or Firm*—Weiser & Stapler

[57] ABSTRACT

This fuel supply is characterized in that a starting pump 49 for supplying the fuel in a fuel tank 25 by suction to a starting nozzle port 41, is driven by a fuel motor 53. Starting of the engine is executed by the use of a starting motor or a recoil starter, by supplying the fuel in the fuel tank 25 to the starting nozzle port 41 through sucking of the fuel with the starting fuel pump 49 which is turned by the fuel motor 53, thereby facilitating the ignition by augmenting the concentration of the mixed gas.

4 Claims, 5 Drawing Sheets

FUEL SUPPLY SYSTEM FOR AN ENGINE

FIELD OF THE INVENTION

The present invention relates to a final supply system for an for engine which facilitates start-up by augmenting the concentration of the fuel at the time of starting the engine.

BACKGROUND ART

Conventionally, a choke device for an engine to facilitate start-up by augmenting the concentration of fuel at the time of starting the engine is arranged, as shown in FIG. 2 and FIG. 3, by pivotally mounting, with shaft 7, a choke valve 5 for opening and closing a suction port 3 of a carburetor 2 provided on an air intake port 1 of the engine so as to be freely oscillatable in the direction perpendicular to an intake gas passage 9. By restricting the area of the sunction port 3 through an oscillatory operation of the choke valve 5, negative pressure created in the intake gas passage 9 is increased by the intake force of the engine. As a result, the amount of the fuel, jetting out of the main nozzle port 11 opened (its mouth) to the intake gas passage 9 is increased, so that the concentration of the fuel contained in sucked gas is also increased, thereby facilitating start-up of the engine.

With such a conventional structure, however, operation was cumbersome because it was necessary to appropriately operate the opening of the choke valve in addition to the starting operation for rotating the crankshaft, and moreover, it was necessary to quickly return and release the choke valve after the engine was started.

Furthermore, a large force was required for starting the engine due to lowering of the intake pressure caused by the closing of the choke valve.

DISCLOSURE OF THE INVENTION

The present invention comprises a starting nozzle port opened to the intake gas passage of the carburetor, a starting fuel pump for supplying the fuel in a fuel tank to the starting nozzle port by sucking the fuel, and a fuel motor for driving the starting fuel pump. According to the present invention, when a switch is pressed, the starting fuel pump is driven by the fuel motor so as to supply the fuel to the starting nozzle by sucking the fuel in the fuel tank. As a result, ignition becomes easy due to the increase of the fuel concentration within the intake gas, which facilitates the start-up of the engine.

PREFERRED EMBODIMENT OF THE INVENTION

Figure 1:
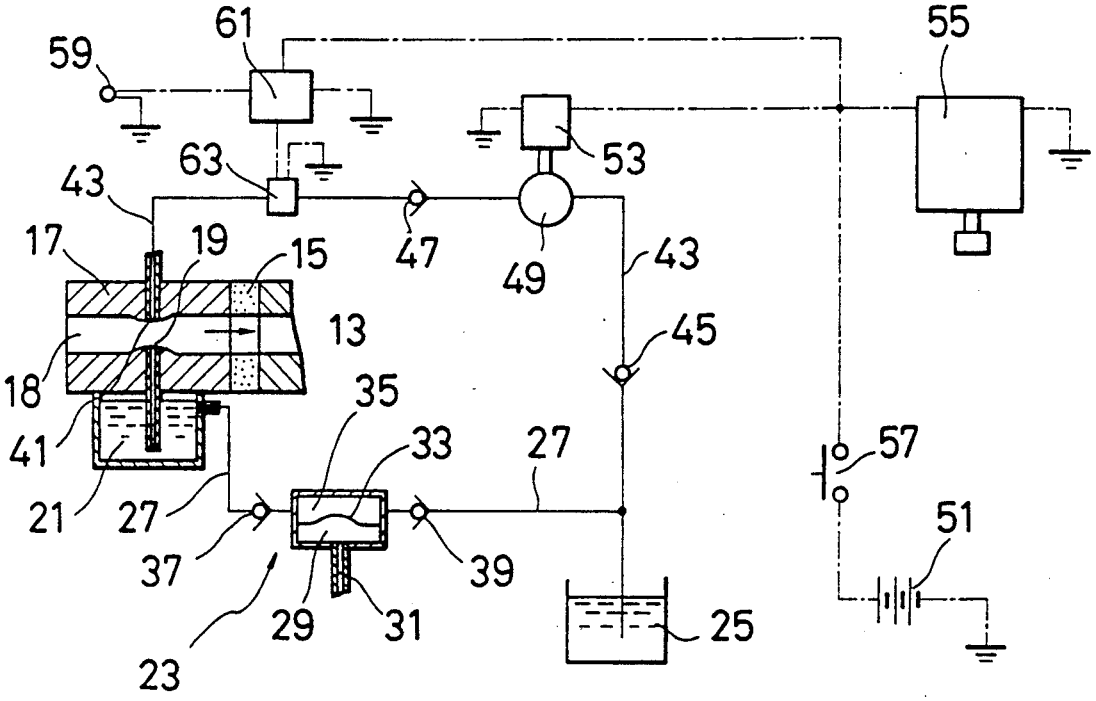
FIG. 1 is an explanatory path diagram for showing the construction of one embodiment of the present invention.
Figure 2:
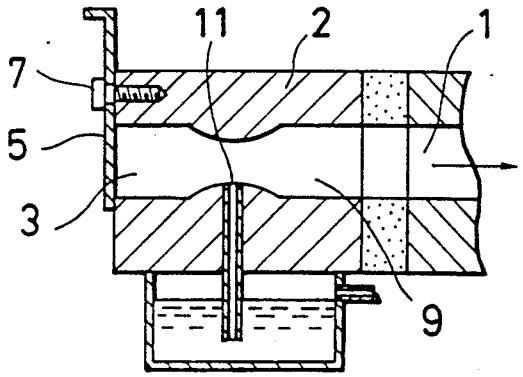
FIG. 2 PRIOR ART
FIG. 2 and FIG. 3 are a side cross sectional view and a front view, respectively, of a conventional device.
Figure 3:
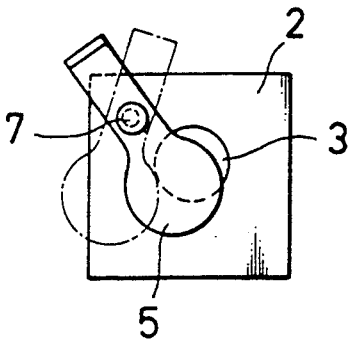
FIG. 3 PRIOR ART

Referring to the drawings, one embodiment of the present invention will be described in detail in what follows.

In FIG. 1, a carburetor 17 is fixed with bolts (not shown) to an intake port 13 of an engine via an insulator 15. A main nozzle port 19 opened to an intake gas passage 18 which is communicated with the intake port, is communicated with a fuel chamber 21 provided in the lower part of the carburetor 17. The fuel chamber 21 is provided with a main fuel passage 27 which communicates the chamber with a fuel tank 25 via a diaphragm pump 23. In the diaphragm pump 23, a pressure chamber 29 and a pump chamber 35 are formed by defining the inside of the diaphragm pump 23 with a diaphragm 33. The diaphragm 33 is vibrated according to the positive and negative pressure in the crankcase which are supplied through a communicating tube 31 communicated with the crankcase. A main fuel passage 27 is communicated with the pump chamber 35 via check valves 37 and 39. In the intake gas passage 18, a starting nozzle part 41 which is connected via a starting fuel passage 43 with the fuel tank 25 is opened. In the starting fuel passage 43, there is provided a starting fuel pump 49 via check valves 45 and 47. The starting fuel pump 49 is driven by a fuel motor 53 having batteries 51 as the power supply. In parallel with the fuel motor 53, there is provided a starting motor 55 which is connected to the batteries 51 via a switch 57 of push-button type. In addition, adjacent to the cylinder (not shown) of the engine, a sensor 59 for detecting the temperature is connected, via a controller 61 connect to the switch 57, to a control valve 63 provided in the starting fuel passage 43. The sensor 59 controls the flow of the fuel in the starting fuel passage 43 to an appropriate level corresponding to the temperature of the cylinder.

With the construction as set forth in the above, when the switch 57 is closed to start the engine, the fuel motor 53 is turned and the starting fuel pump 49 is driven to inject the fuel in the fuel tank 25 into the intake gas passage 18 through the starting nozzle port 41. At the same time, the starting motor 55 is driven to turn the crankshaft to start the engine. Here, the amount of the fuel jetted out of the starting nozzle port 41 is controlled to an appropriate quantity by adjusting the opening of the control valve 63 which is operated by a command issued from the controller 61 in accordance with the temperature of the cylinder detected by the sensor 59. Once the engine is started, the diaphragm 33 vibrates corresponding to the variations in the pressure within the crankcase, and the fuel in the fuel tank 25 is jetted out of the main nozzle port 19 into the intake gas passage 18, thereby sustaining the operation of the engine.

As described in the above, according to the present invention, by operating a switch, it is possible to increase the concentration of the intake gas through increased jetting of the fuel into the carburetor, which facilitates the ignition of the engine, and enables an easy and sure starting of the engine.

It should be noted that although the starting nozzle port 41 is provided separately from the main nozzle port 19 in the above embodiment, it is possible to use the main nozzle port also as the starting nozzle port. In addition, the fuel motor and the starting motor may be used in common.

Furthermore, it is possible to make use of a manual recoil starter in place of the starting motor.

Still further, it is possible to provide a fuel reservoir in the starting fuel passage which communicates the fuel tank with the starting nozzle port. In this case, by supplying fuel to the fuel reservoir using the starting fuel pump, it becomes possible to supply fuel from the fuel reservoir to the starting nozzle port by means of the pressure of the starting fuel pump or the sucking power of the engine.

FIG. 4 through FIG. 7 describe other embodiments equipped with a fuel reservoir in the starting fuel passage. Namely, these embodiments are equipped with a starting nozzle port opened to the intake gas passage of the carburetor and a starting fuel pump for supplying the fuel in the fuel tank to the fuel reservoir, whereby the fuel in the fuel reservoir is transferred to the starting nozzle port via the starting nozzle passage by means of the pressure of the starting fuel pump or the sucking power of the engine, and the fuel motor for driving the starting fuel pump and the starting motor for starting the engine are interlocked so as to actuate them in succession. With a single pressing of the switch, the fuel motor drives the starting fuel pump to cause it to suck the fuel in the fuel tank to be supplied to the fuel reservoir. After the fuel reservoir is filled with the fuel, fuel is jetted out of the starting nozzle port by actuating the starting motor to drive the fuel motor concurrently or by the sucking force of the engine. In this manner, the fuel motor and the starting motor are actuated automatically in sequential fashion by a single operation of the switch.

Figure 4:
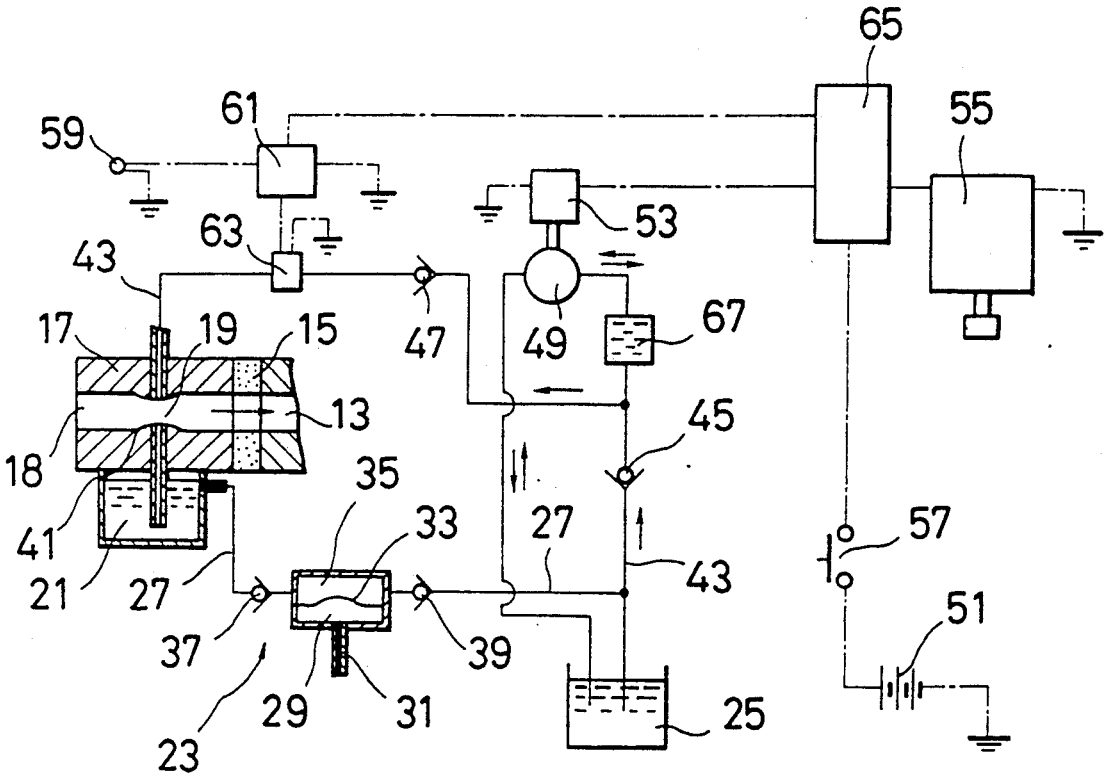
FIG. 4 is an explanatory path diagram for showing the construction of an embodiment equipped with an oil reservoir.
Figure 5:
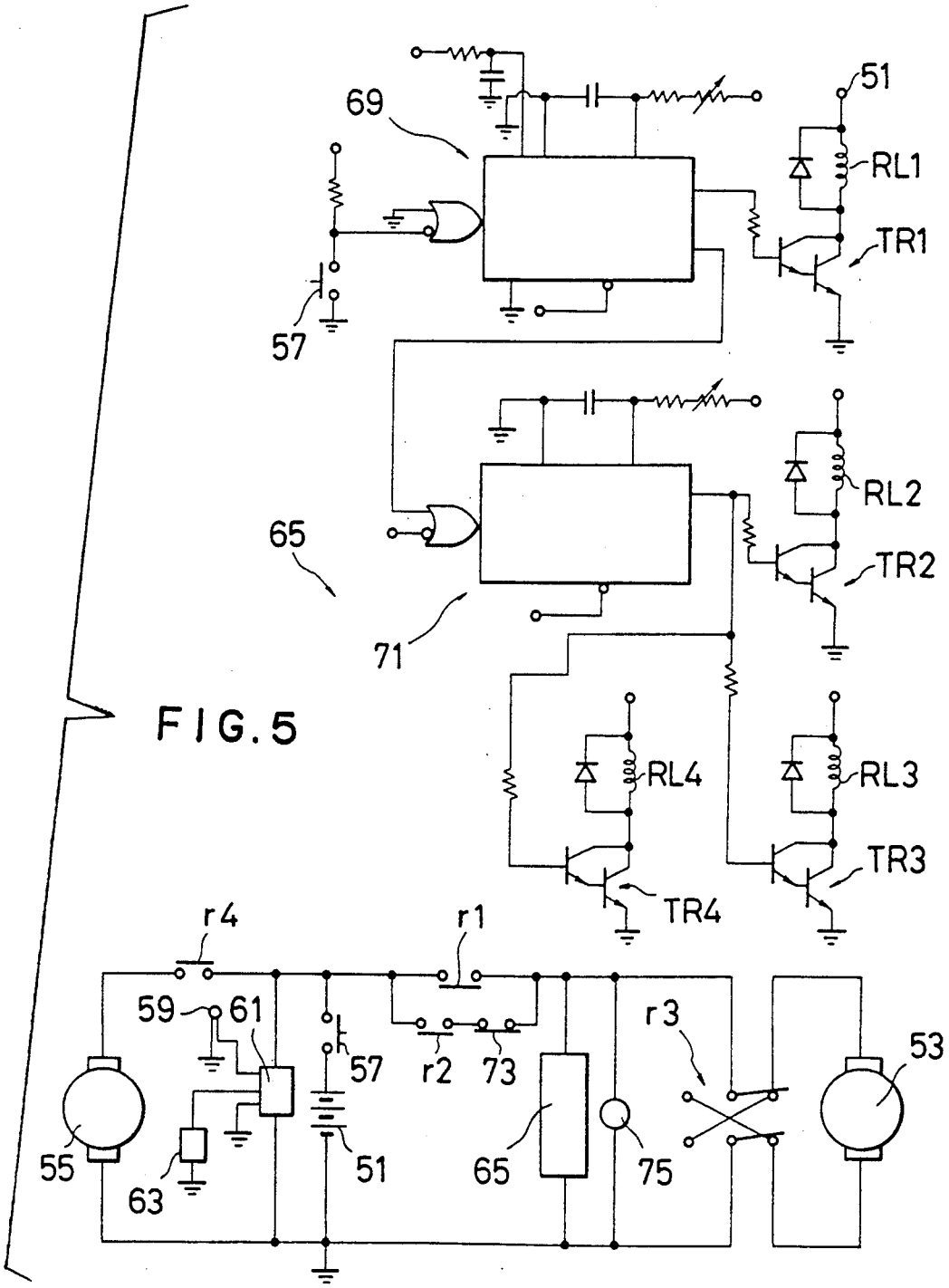
FIG. 5 is an explanatory diagram for showing the electrical circuit of the embodiment.

In FIG. 4 and FIG. 5, the carburetor 17 is fixed via an insulator 15 to the intake port 13 of the engine by means of bolts (not shown). The main nozzle port 19 which is opened to the intake gas passage 18 communicated with the suction port 13 is communicated with the fuel chamber 21 provided in the lower part of the carburetor 17. The fuel chamber 21 is connected to a main fuel passage 27 which communicates the chamber with the fuel tank 25 via the diaphragm pump 23. The pressure chamber 29 of the diaphragm pump 23 is provided with a diaphragm 23 which partitions the inside of the pressure chamber 35. The diaphragm 23 is vibrated corresponding to the positive and negative pressures in the crankcase (not shown) transmitted through the communicating tube 31 which is communicated with the crankcase of the engine. The main fuel passage 27 is communicated with the pump chamber 35 via check valves 37 and 39. The starting nozzle port 41 is opened to the intake gas passage 18 which is communicated with the fuel tank 25 via the starting fuel passage 43. The starting fuel passage 43 is provided via check valves 45 and 47 with starting fuel pump 49. The starting fuel pump 49 uses the batteries 51 as the power supply and is driven, via the push-button type switch 57 and a main control device 65, freely rotatably in the forward as well as the reverse directions by the fuel motor 53. One end of the starting fuel pump 49 is communicated via a fuel reservoir 67 with a position in the starting fuel passage 43 intermediate between the check valves 45 and 47 while the other end is communicated with the fuel tank 25. Further, adjacent to the cylinder (not shown) of the engine, there is provided a sensor 59 for detecting the temperature connected to the control valve 63 provided in the starting fuel passage 43 via the controller 61 connected to the switch 57, in order to control the quantity of the fuel that flows in the starting fuel passage 43 corresponding to the temperature of the cylinder.

The main control device 65 is constructed as in the following. Namely, a first controller 69 connected to the switch 57 is connected in parallel with a second controller 71 and a transistor $TR_1$, and the transistor $RT_1$ is connected via the power supply (batteries) to a relay $RL_1$. The second controller 71 is connected in parallel with transistors $TR_2$, $TR_3$ and $TR_4$, and the transistors $TR_2$, $TR_3$ and $TR_4$ are connected via relays $RL_2$, $RL_3$ and $RL_4$, respectively, to the power supply. A starting motor 55 is connected via a contact $r_4$ of the relay $RL_4$ to the power supply 51, and the fuel motor 53 is connected via a contact $r_3$ of the relay $RL_3$ for switching the forward and reverse rotations to the power supply. Between the contact $r_3$ and the power supply 51 there are connected in parallel a contact $r_1$ of the relay $RL_1$ and a contact $r_2$ of the relay $RL_2$. A temperature switch 73 is connected in series with the contact $r_2$. An electronic buzzer 75 is connected in parallel with the fuel motor 53. A timer is incorporated in the first controller 69 in such a way as to energize the transistor $TR_1$ and disconnect the current to the transistor $TR_1$ after elapse of a predetermined length of time, and then to switch electrical energization to the second controller 71.

With the above construction, when the switch 57 is depressed to start the engine, the transistor $TR_1$ is actuated to energize the relay $RL_1$ to connect the contact $r_1$. The fuel motor 53 is rotated forwardly to cause the starting fuel pump 49 to rotate, and the fuel in the fuel tank 25 is sucked through the check valve 45 and the fuel reservoir 67 to the starting fuel pump 49, and is circulated to the fuel tank 25. After elapse of a predetermined time required for filling the fuel reservoir 67, the timer in the first controller 69 is actuated to disconnect the transistor $TR_1$ and the contact $r_1$. At the same time, the relays $RL_2$, $RL_3$ and $RL_4$ are energized by the transistors $TR_2$, $TR_3$ and $TR_4$, which action connects the contact $r_2$ and energizes the contact $r_3$ to rotate the starting motor 55 in the reverse direction. Then, the starting fuel pump 49 is rotated in the reverse direction to cause the fuel in the fuel reservoir 67 to be sent through the check valve 47 to the starting nozzle port 41 to be jetted out into the intake gas passage 18. At the same time, the contact $r_4$ is connected to rotate the starting motor 55 which causes the engine to be rotated, thereby starting the engine. The fuel jetted from the starting nozzle port 41 is controlled by a command sent from the controller 61 to the control valve 63 to send an appropriate amount of fuel corresponding to the temperature contained in the command by adjusting the opening of the control valve 63. Once the engine is rotated, the diaphragm 33 is vibrated in response to the variations in the pressure, and the fluid in the fluid tank 25 is jetted out by the diaphragm pump 23 from the main nozzle port 19 into the intake gas passage 18, thereby sustaining the operation of the engine.

When the push-button type switch is opened, all of the relays $RL_1$, $RL_2$, $RL_3$ and $RL_4$ are de-energized, all of the contacts $r_1$, $r_2$, $r_3$ and $r_4$ return to their original positions and the starting motor 55 and the fuel motor 53 are brought to a stop.

In addition, when the temperature of the engine or the surroundings is sufficiently high such that it does not require the fuel from the starting nozzle port 41, a temperature switch 73 located at an appropriate position is opened. Then, the fuel motor 53 will not be rotated in the reverse direction and the jetting of the fuel from the starting nozzle port 41 will not take place.

Figure 6:
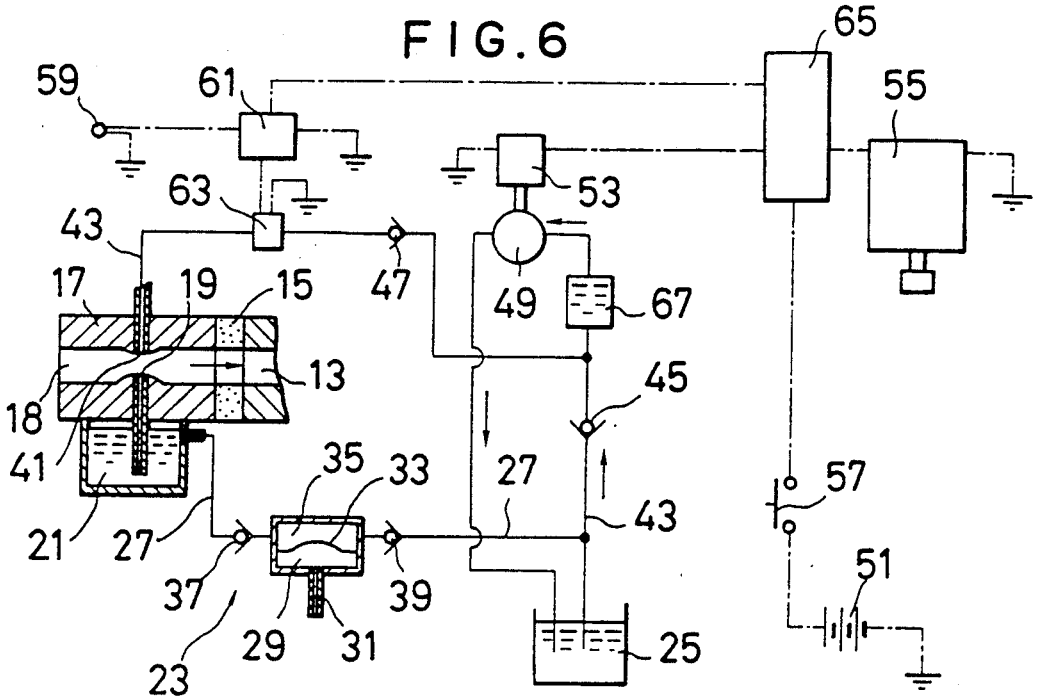
FIG. 6 and FIG. 7 are explanatory diagrams for a second and a third embodiment, respectively, of the device equipped with an oil reservoir.

Moreover, FIG. 6 shows another embodiment of the device of the type wherein the fuel pump 49 does not rotate in the reverse direction and the fuel in the fuel reservoir 67 is sucked and jetted out of the starting nozzle port 41 by means of the sucking force of the engine. The sequential operation in which the starting motor is actuated with elapse of a predetermined length of time after the fuel motor is rotated is identical to the previous embodiment.

Figure 7:
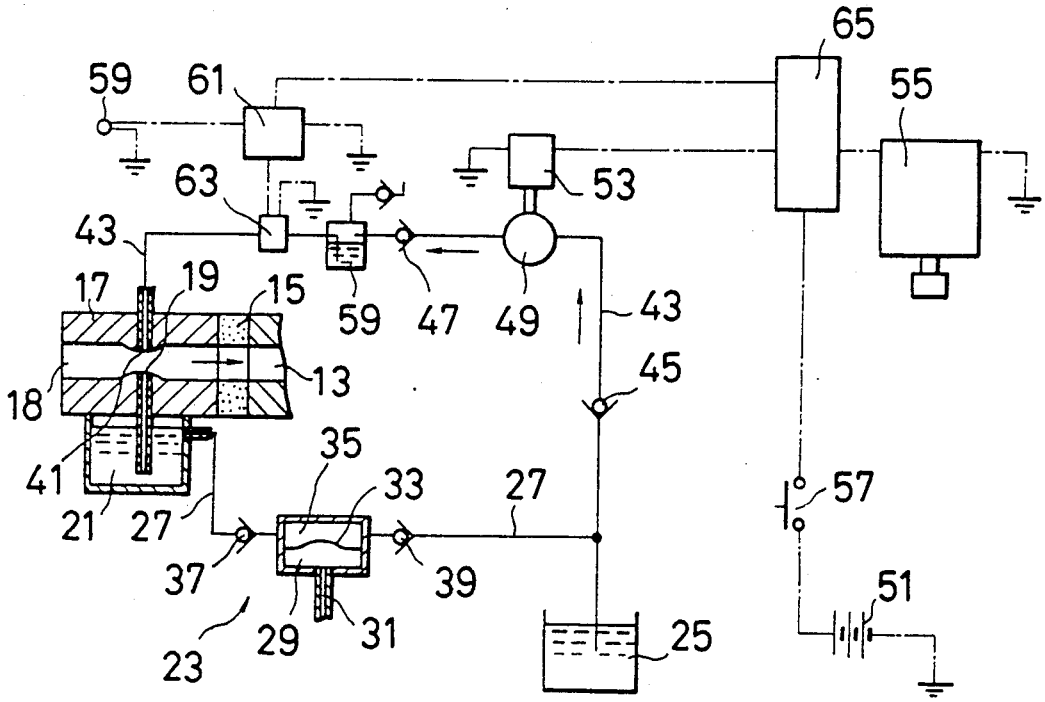

Further, FIG. 7 shows a third embodiment wherein the discharge side of the starting fuel pump 49 is connected to the starting nozzle port 41, with the fuel reservoir 67 provided between the pump 49 and the port 41. It is analogous to the previous embodiment that the fuel motor 53 and the starting motor 55 are sequentially operated by means of a timer.

Moreover, the present invention may be arranged, instead of using a timer, to operate the fuel motor and the starting motor sequentially by detecting the fuel in the fuel reservoir by means of a pressure switch or the like provided in the fuel reservoir.

As described above, in these embodiments equipped with a fuel reservoir, it is possible by a single pressing of the switch to actuate the fuel motor to supply the fuel to the fuel reservoir and then automatically actuate in sequence the starting motor of the engine. Thereby, it becomes possible to facilitate the ignition of the engine by augmenting the concentration of the intake gas through an increased jetting of the fuel into the carburetor, and to execute an easy and sure starting of the engine.

It should be noted that in the aforementioned embodiments, the starting nozzle port 41 is provided separately from the main nozzle port 19, but the main nozzle port may also serve as the starting nozzle port.

Figure 8:
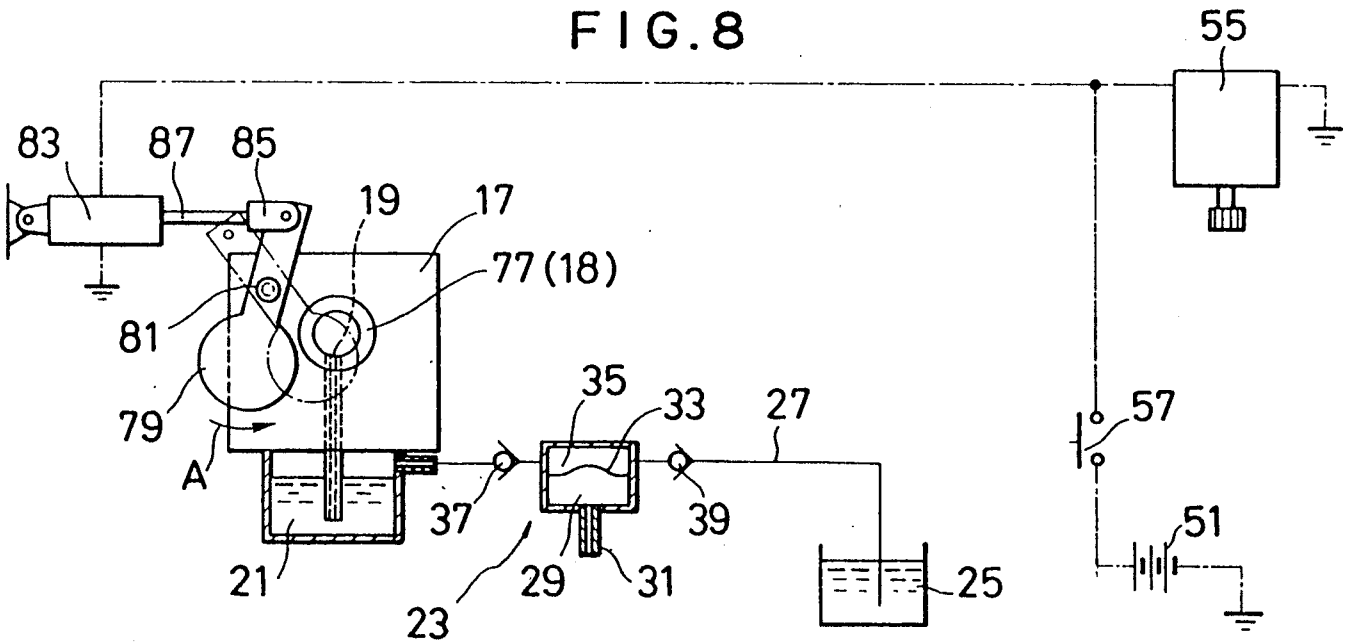
FIG. 8 is an explanatory path diagram for showing the construction of another embodiment.
Figure 9:
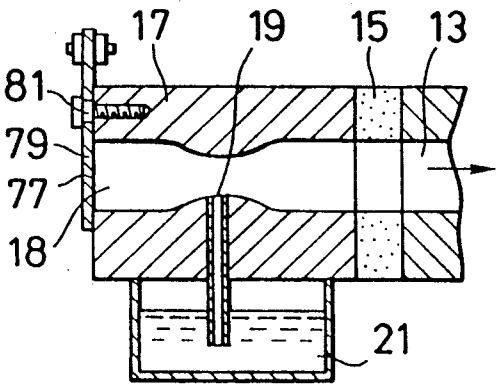
FIG. 9 is a side cross sectional view of the principal parts of the device shown in FIG. 8.

In addition, FIG. 8 and FIG. 9 show other fuel supply systems wherein there are provided a choke valve for opening and closing the intake gas passage of the carburetor and an operating device for opening and closing the choke valve, where the operating device is interlocked with the starting motor for starting the engine. By the pressing of the starting switch, the starting motor turns the crankshaft, and at the same time, augments the concentration of the fuel in the intake gas by restricting the intake gas passage by means of a choke valve, thereby facilitating the ignition and the starting of the engine. Namely, a choke valve 79 for opening and closing a suction port 77 of the intake gas passage 18 is pivotally mounted with a shaft 81 freely oscillating in the direction perpendicular to the intake air passage 18. The choke valve 79 is arranged to be operated oscillatably by means of an operating device (an electromagnetic device in this embodiment) 83. That is, a coupling unit 85 which is mounted pivotally on the other end of the choke valve 79 is coupled via a coupling rod 87 to the electromagnetic device 83 (operating device), and causes the choke valve 79 to move in the direction of the arrow A in FIG. 8 when a current is passed through the electromagnetic device 83. The electromagnetic device 83 is connected to the push button 57 in parallel with the starting motor 55, using the batteries 51 charged by a generator driven by the engine as its power supply.

With the construction as set forth in the above, in starting the engine by closing the switch 57, the choke valve 79 is closed by the operation of the electromagnetic device 83, and at the same time, the starting motor 55 is driven to turn the crank shaft to start the engine. When the engine is started, the diaphragm 33 is vibrated in response to the variations in the pressure of the crankcase, and the fuel in the fuel tank 25 is jetted out into the intake air passage 18 from the main nozzle port 19 by means of the diaphragm pump 23, thereby sustaining the operation of the engine. When the switch 57 is opened, the starting motor 55 is stopped and the choke valve 79 is returned to the opened position.

What is claimed is:

1. A fuel supply system for an internal combustion engine having a fuel tank, a combustion chamber defined in an engine cylinder, an intake air passage communicated to the combustion chamber and having a venturi portion, and a crankcase having an inside pressure which changes in response to cranking of the engine, comprising:

a main fuel passage communicating the fuel tank and the intake air passage;

first supply means provided on the main fuel passage for supplying main fuel from the fuel tank to the intake air passage responsive to cranking of the engine, wherein the first supply means comprises a diaphragm device for delivering fuel from the fuel tank into the intake air passage, the diaphragm device communicating with the crankcase so that the main fuel flows into and out of the diaphragm device in response to pressure changes in the crankcase;

a starting fuel passage communicating the fuel tank and the intake air passage, which is separate from the main fuel passage;

second supply means provided on the starting fuel passage for supplying an appropriate amount of starting fuel from the fuel tank into the intake air passage, in addition to the main fuel, in accordance with the temperature of the engine cylinder and upon starting of the engine, wherein the second supply means includes a pump for delivering starting fuel from the fuel tank to the starting fuel passage;

means for detecting the temperature of the engine cylinder; and valve means provided between the pump and the intake air passage for controlling the starting fuel to be supplied into the intake air passage in accordance with the detected temperature of the cylinder;

wherein the main fuel passage and the starting fuel passage communicate with the venturi portion of the intake air passage so that both the main fuel and the starting fuel are supplied into the intake air passage at the venturi portion.

2. The fuel supply system of claim 1 wherein the detecting means comprises a sensor which produces an output signal according to the detected temperature of the cylinder, the valve means includes a control valve capable of controlling a flow passing therethrough, and having means for operating the control valve in accordance with the output signal from the sensor so that the supply of the starting fuel is adjusted to the appropriate amount.

3. The fuel supply system of claim 1 wherein the first supply means further includes a first check valve connected between the fuel tank and the diaphragm device for permitting the fuel to flow only in a direction from the fuel tank to the diaphragm device, and a second check valve connected between the diaphragm device and the intake air passage for permitting the fuel to flow only in a direction from the diaphragm device to the intake air passage.

4. The fuel supply system of claim 1 wherein the internal combustion engine is a two-cycle engine.

* * * * *